US005126619A

United States Patent [19]

Wakimizu et al.

[11] Patent Number: 5,126,619

[45] Date of Patent: Jun. 30, 1992

[54] DISCHARGE LAMP UNIT

[75] Inventors: Yukio Wakimizu; Hirohiko Ohshio, both of Shizuoka, Japan

[73] Assignee: Koito Manufacturing Co., Ltd., Tokyo, Japan

[21] Appl. No.: 730,717

[22] Filed: Jul. 16, 1991

[30] Foreign Application Priority Data

Jul. 20, 1990 [JP] Japan ..... 2-190772
Feb. 7, 1991 [JP] Japan ..... 3-16447

[51] Int. Cl.[5] ..... H01J 5/48; H01K 33/02

[52] U.S. Cl. ..... 313/25; 313/112; 313/318; 439/230; 439/237; 439/604; 362/264; 362/373; 445/26; 445/27

[58] Field of Search ..... 313/25, 318, 112; 439/230, 237, 247, 604, 605, 606; 362/264, 373; 445/26, 27, 29

[56] References Cited

U.S. PATENT DOCUMENTS 1,081,581 12/1913 Crossley ..... 439/605

2,175,361 10/1939 Reget et al. ..... 313/25

*Primary Examiner*—Donald J. Yusko
*Assistant Examiner*—Diab Hamadi
*Attorney, Agent, or Firm*—Sughrue, Mion, Zinn, Macpeak & Seas

[57] ABSTRACT

A discharge lamp unit in which a pair of terminal and lead support assemblies (A, B), composed of a pair of metal connector terminals (123, 125) and a pair of metal lead supports (122, 124), are fixedly held by a molded resin lamp holder (120) in such a manner that the connector terminals (123, 125) extend from the rear surface of the lamp holder while the lead supports (122, 124) extend from the front surface of the lamp holder to support a discharge lamp (110). The lamp holder has an axial through-hole formed therein during the molding of the lamp holder in a metal mold in such a manner that the axial through-hole is located between the connector terminals of the terminal and lead support assemblies, whereby the lamp holder is enhanced in dielectric strength.

20 Claims, 8 Drawing Sheets

DISCHARGE LAMP UNIT

BACKGROUND OF THE INVENTION

The present invention relates to discharge lamp units, and more particularly to a discharge lamp unit in which a discharge lamp having discharge electrodes confronted with each other in a closed glass envelope is supported by a pair of lead supports protruding from a lamp holder.

A conventional discharge lamp unit of this type is constructed as shown in FIG. 1. A pair of lead supports 3 and 4 serving as conductors are embedded, in an insulating base 2, which is a lamp holder and is made of synthetic resin. The lead supports 3 and 4 support a discharge lamp 5, which is constructed as follows:

A pair of electrodes 6 are held confronted with each other in a closed glass tube 5*a*. The electrodes 6 are electrically connected to two lead wires 7 which are connected to respective ones of metal supports 8*a* and 8*b*. The metal supports 8*a* and 8*b* are mounted on the lead supports 3 and 4, respectively. The lead supports 3 and 4 are welded to terminals 9*a* and 9*b*, respectively, which are embedded in the insulating base 2 in such a manner that they extend outward from the side of the base 2 opposite to the side where the discharge lamp is mounted.

In assembling the discharge lamp unit, the lead supports 3 and 4 are welded to the terminals 9*a* and 9*b*, respectively, in advance, and then the assembly of the lead supports and the insulating base is then molded around the terminals. Thereafter, the metal supports 8*a* and 8*b* are welded to the lead supports 3 and 4, respectively, and then the discharge lamp 5 is secured to the metal supports 8*a* and 8*b*.

The above-described discharge lamp unit is disadvantageous in the following points: If the spot-welding margins of the terminals 9*a* and 9*b* and the lead supports 3 and 4 are not large enough, then the former may not positively welded to the latter. Moreover, if the distance A between the surface of the base 2 of resin and the end faces of the terminals 9*a* and 9*b* is not long enough, the end portion of the terminals may be exposed, appearing at the surface of the base 2. In such a case, an electrical discharge may occur between the lead support 3 and the exposed end portion of the terminals 9*b*. In order to eliminate this difficulty, it is necessary that the wall thickness d of the resin base 2 be sufficiently large. However, since the base 2 is formed by molding synthetic resin, sometimes it includes blowholes 2*a*, as shown in FIG. 2. The probability that blowholes 2*a* are formed in the base 2 increases with the wall thickness of the base 2. If blowhole cracks are present in the terminal region of the base 2, then current can flow between the terminals through the blowholes, as indicated by arrows in FIG. 9. That is, the dielectric strength of the base is lowered, and accordingly electrical discharge occurs between the terminals 9*a* and 9*b*. As is apparent from the above description, the conventional discharge lamp unit suffers from a difficulty that, in the case where it is intended to increase the dielectric strength by increasing the wall thickness of the base, sometimes blowholes are formed in the base, thus lowering the dielectric strength.

SUMMARY OF THE INVENTION

In view of the foregoing, an object of the invention is to provide a discharge lamp unit having a lamp holder high in dielectric strength.

The foregoing and other objects of the invention have been achieved by the provision of a discharge lamp unit in which a pair of terminal and lead support assemblies, each composed of a metal connector terminal and a metal lead support, are fixedly held by a lamp holder made of resin in such a manner that the connector terminals of the pair of terminal and lead support assemblies extend from the rear surface of the lamp holder while the lead supports of the pair of terminal and lead support assemblies extend from the front surface of the lamp holder to support a discharge lamp. According to the invention, the lamp holder has an axial through-hole which is formed therein when the holder is molded in a metal mold in such a manner that the axial through-hole is located between the connector terminals of the terminal and lead support assemblies.

In the discharge lamp unit, the axial through-hole is preferably an elongated hole which is laid in such a manner as to isolate the connector terminals from each other.

The wall defining the axial through-hole is formed by molten resin material being pushed tight against adjacent portions of the metal mold used to form the holder. Accordingly, the region around the axial through-hole is higher in material density, and at least in the region of the lamp holder near the axial through-hole, the formation of blowholes is suppressed when the lamp holder is molded. The amount of increase in dielectric strength due to the fact that the material density is increased and no blowholes are formed exceeds the amount of decrease in dielectric strength due to the presence of an air layer in the axial through-hole, so that the dielectric strength of the lamp holder is increased in the region where the pair of connector terminals are positioned.

Moreover, by forming the axial through-hole as an elongated hole arranged in such a manner as to isolate the connector terminals from each other, the dielectric strength of the region where the connector terminals are located is increased.

DESCRIPTION OF THE PREFERRED EMBODIMENTS

Figure 1:
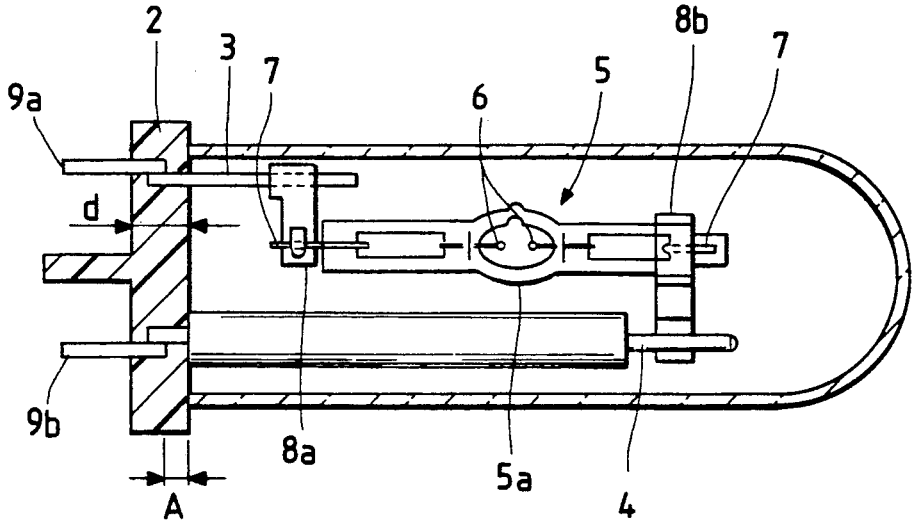
FIG. 1 PRIOR ART
FIG. 1 sectional view showing a conventional discharge lamp.
Figure 2:
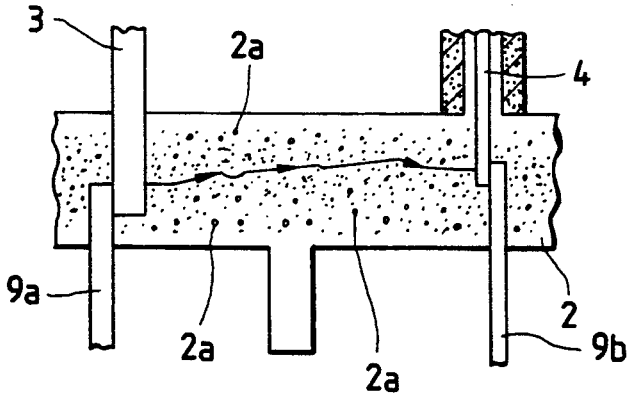
FIG. 2 PRIOR ART
FIG. 2 is an explanatory diagram for a description of the occurrence of electric discharge between the connector terminals of the conventional discharge lamp unit.
Figure 3:
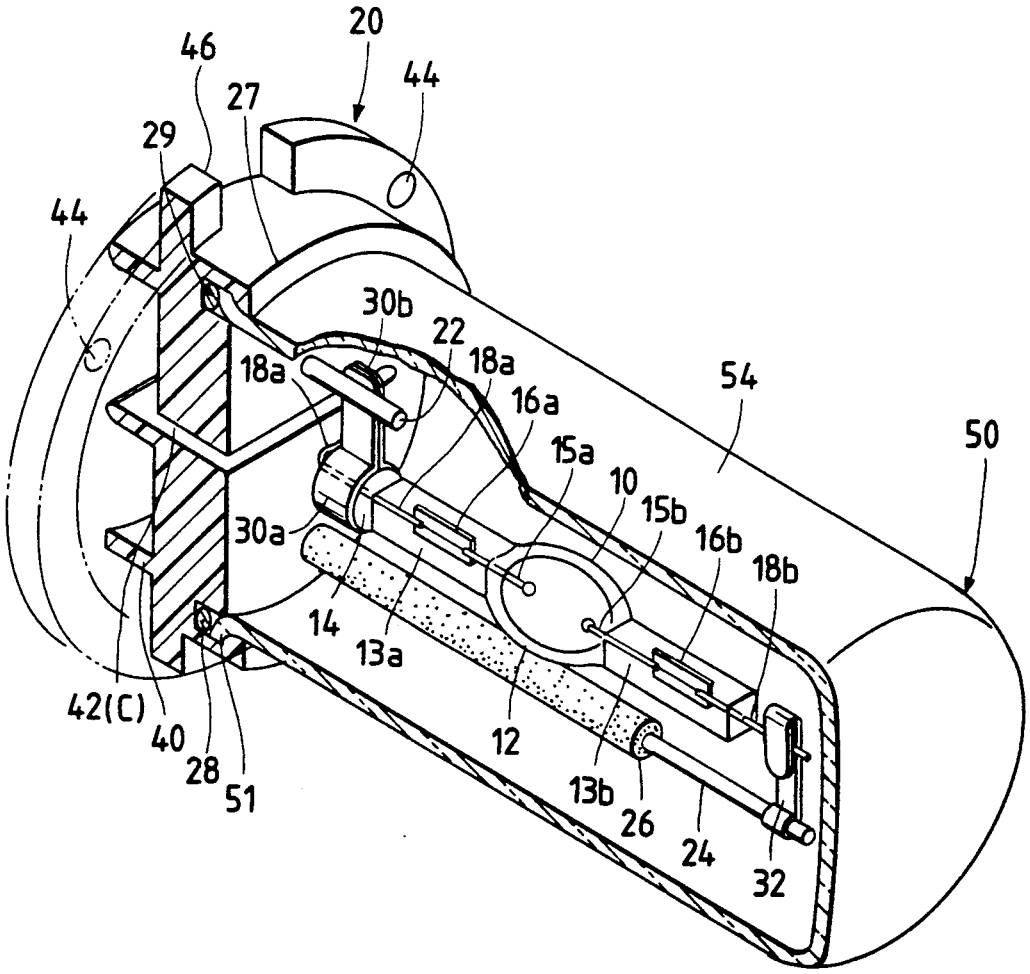
FIG. 3 is a perspective view, with parts cut away, shoiing a first embodiment of a discharge lamp unit constructed according to the invention.
Figure 4:
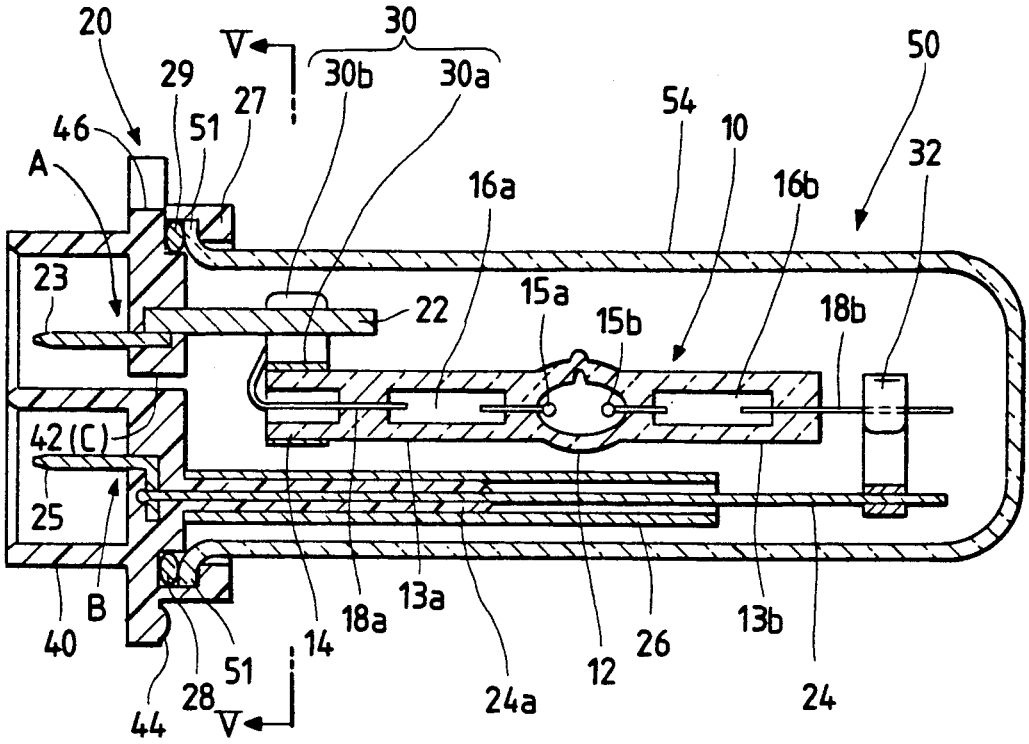
FIG. 4. is a longitudinal sectional diagram showing the discharge lamp unit of FIG. 3.
Figure 5:
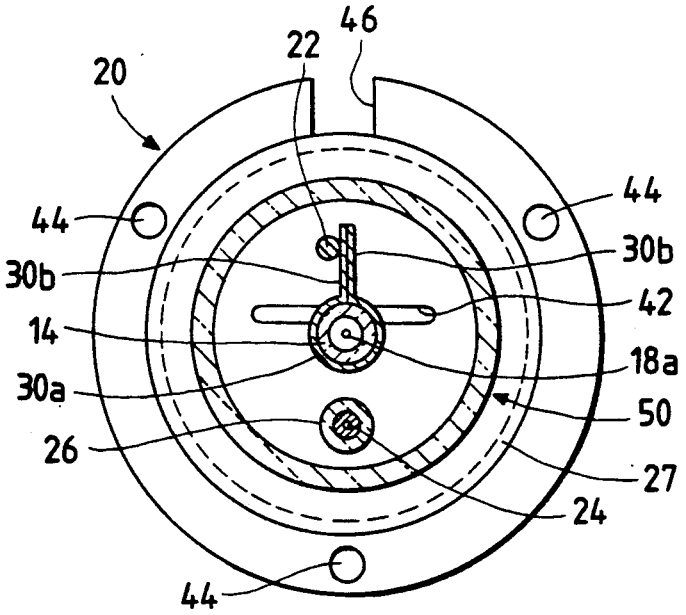
FIG. 5 is a cross sectional view taken along line V—V in FIG. 4.

A first embodiment of discharge lamp unit of the invention, as shown in FIGS. 3 through 5, includes a light emitting section, namely, a discharge lamp 10, lead supports 22 and 24 protruding from a lamp holder, namely, an insulating base 20, to support the discharge lamp 10, and an ultraviolet ray shielding globe 50 secured fixedly to the insulating base 20 to surround the discharge lamp 10.

The discharge lamp 10 is constructed as follows: A cylindrical-pipe-shaped quartz glass tube is pinched near both ends in such a manner as to form a closed glass ball 12 with pinch-sealed portions 13*a* and 13*b* at both ends, thus defining an electric discharge space. The pinch-sealed portions 13*a* and 13*b* are each rectangular in longitudinal section, and the closed glass ball 12 is elliptical in longitudinal section. A starting rare gas, mercury and metal halogenide are sealed in the glass ball 12. The pinch-sealed portion 13*a* is integral with an elongation 14 in the form of a cylindrical sleeve, which is not pinch-sealed. The elongation 14 is held with a metal support 30 (described later). Discharge electrodes 15*a* 15*b* made of tungsten are disposed in the electric discharge space in such a manner that they are confronted with each other. The discharge electrodes 15*a* and 15*b* are connected to molybdenum foils 16*a* and 16*b* sealed in the pinch-sealed portions 13*a* and 13*b*, respectively. The other ends of the molybdenum foils 16*a* and 16*b* are connected to lead wires 18*a* and 18*b*, respectively, which protrude from the ends of the pinch-sealed portions 13*a* and 13*b*, respectively. A short lead support 22 and a long lead support 24 are embedded in the insulating base 20 in such a manner that they extend forwardly of the base 20 The lead supports 22 and 24 support the discharge lamp 10 at both ends through metal supports 30 and 32 engaged therewith.

The insulating base 20 is made of a synthetic resin such as PPS (polyphenefene sulfide). A flat-plate-shaped connector terminal 23 (FIG. 4) is connected to the lead support 22 by spot welding in such a manner that it extends from the rear surface of the insulating base 20, while an L-shaped connector terminal 25 connected to the lead support 24 by plasma welding extends from the rear surface of the base 20. The connector terminals 23 and 25 are surrounded by a box-shaped partition wall 40, so that the occurrence of electric discharge between the connector terminals 22 and 25 is prevented. The connection of the terminal 23 and the lead support 22, and the connection of the terminal 25 and the lead support 24, are fixedly held by the insulating 20 base during insertion molding.

The insulating base 20 has a through-hole 42 between the lead supports 22 and 24 arranged so as to separate the terminals 23 and 25 from each other. One might expect that the presence of an air layer C (which is lower in dielectric strength than the base forming material) in the through-hole 42 between the conductor assembly A of the terminal 23 and the lead support 22 and the conductor assembly B of the terminal 25 and the lead support 24 would lower the dielectric strength of the insulating base. However, since, in the molding of the insulating base 20, the molten resin material which forms the wall of the through-hole is pushed tightly against the metal mold so that the material around the through-hole is increased in density, the amount of increase in dielectric strength due to the fact that the material around the through-hole is higher in density exceeds the amount of decrease in dielectric strength due to the presence of the air layer C. That is, the insulating base having the through-hole 42 is higher in dielectric strength than the insulating base having no through-hole, and accordingly electrical discharge between the conductor assemblies A and B is substantially prevented.

Also, the space around the discharge lamp in the globe 50 is communicated through the through-hole 42 with the outside. This communication contributes to the convection of air between the inside and outside of the globe 50, thus accelerating heat radiation from the globe 50.

The metal support 30 is formed as follows: The middle portion of a belt-shaped metal plate having a predetermined width is bent into an arcuate lamp holding portion 30*a*. The remaining portions, namely, both end portions of the metal plate, are left as they are, being employed as plate-shaped flange portions 30*b* and 30*b*. With the plate-shaped flange portions 30*b* and 30*b* abutted against each other, the elongation 14 of the discharge lamp is held with the lamp holding portion 30*a*. Under this condition, the flange portions 30*b* and 30*b* are connected to the end portion of the lead support 30 by spot welding. Accordingly, the discharge lamp 10 can be slid with respect to the lamp holding portion 30*a* in an axial direction (to the right or to the left in FIG. 3), or it can be turned around its axis; that is, the discharge region of the discharge lamp 10 can be suitably positioned with respect to the reflector (not shown).

The rear lead wire 18*a* extending from the elongation 14 of the discharge lamp is spot welded to the metal support 30. The metal support 32 supporting the front end portion of the discharge lamp 10 is also formed by bending a belt-shaped metal plate having a predetermined width by clamping one end portion of the belt-shaped metal plate on the end portion of the lead support 14 and spot welding those members, while the other end portion is folded to hold the front lead wire 18*b* and spot welded to it.

In FIGS. 3 through 5, reference numeral 26 designates a discharge preventing insulating cylinder made of ceramic which covers a portion 24*a* of the lead support 24.

The insulating base 20 has a frame 27 which is L-shaped in section on the front surface. The frame 27 has an annular globe mounting groove 28 with which the outer flange 51 of the ultraviolet ray shielding globe 50 (described later in detail) is engaged. An O-ring 29 is fitted in the globe mounting groove 28 so as to elastically hold the outer flange 51 of the globe 50. The frame 27 is joined to the base 20 by first placing the outer flange 51 of the globe 50 on the O-ring 29, and then, with the O-ring 29 compressed, connecting an annular member L-shaped in section for forming the frame to the front surface of the base 20 by ultrasonic welding.

Reference numeral 50 designates the aforementioned ultraviolet ray shielding globe, which is closed at the front end like a cup. The globe 50 is fixedly mounted on the insulating base, enclosing the lead supports 22 and 24 and the discharge lamp 10. The aforementioned outer flange 51 extends from the edge of the opening of the globe 50 so as to engage the globe mounting groove 28. The globe is made of glass, and the outer wall of the globe 50 is coated with an ultraviolet ray shielding film 54 of ZnO. Therefore, with the globe 50 mounted fixedly on the base 20, the ultraviolet ray shielding film 50 covers the discharge lamp 10 so that it absorbs the ultraviolet rays which the discharge lamp 10 produces when emitting light, as a result of which only visible light from which ultraviolet rays have been removed is allowed to emerge from the globe 50. In order to reduce to zero the transmittance of ultraviolet rays shorter than 370 nm in wavelength, the thickness of the ultraviolet ray shielding film should be at least 1.6 μm. In order to prevent the film from coming off the globe, it is preferable that the thickness is 5 μm or less. The wavelength range of ultraviolet rays which can be cut off depends on the temperature around the globe (the wavelength range being shifted towards the long wavelength range as the temperature increases). Hence, the film thickness is set to a value at which ultraviolet rays 370 to 380 nm or less in wavelength can be cut off.

The ultraviolet ray shielding film can be formed by dipping, vacuum deposition, spraying, and other coating methods. In the case where the dipping method is employed, the thickness of the ultraviolet ray shielding film can be adjusted by changing the speed of extracting the globe out of the coating solution, or by changing the number of times of dipping the globe in the coating solution. In the case where the vacuum deposition method is employed, the film thickness can be adjusted by changing the frequency of vacuum deposition. In the case where the spraying method is employed, the film thickness can be adjusted by changing the coating solution spraying frequency.

In FIGS. 3 through 5, reference numeral 44 designates protrusions formed on the front surface of the peripheral portion of the insulating base 20 to position the bulb (or the discharge lamp unit) in the axial direction. More specifically, the protrusions 44 are abutted against the wall in which the bulb mounting hole (not shown) is formed, thereby to position the bulb in the axial direction.

Further in FIGS. 3 through 5, reference numeral 46 designates a circumferential positioning slot formed in the peripheral portion of the insulating base 20. When the bulb (or the discharge lamp unit) is engaged with the bulb mounting hole (not shown), the slot 46 is engaged with a protrusion formed on the side of the bulb mounting hole to position the bulb in the circumferential direction.

In the above-described embodiment, the lead supports are welded to respective ones of the connector terminals. However, the invention is not limited thereto or thereby. For instance, a metal plate may be bent and shaped to form each of the assemblies of the lead supports and the connector terminals.

As is apparent from the above description, in the discharge lamp unit according to the invention, when the lamp holder is molded, the material which forms the through-hole wall is pushed tightly against the metal mold so that the material defining the through-hole is increased in density, thus suppressing the formation of blowholes in the lamp holder and increasing the dielectric strength thereof. The amount of increase in dielectric strength exceeds the amount of decrease in dielectric strength due to the presence of the air layer in the through-hole. That is, the amount of increase in dielectric strength due to the fact that the material around the through-hole is higher in density exceeds the amount of decrease in dielectric strength due to the presence of the air layer in the through-hole. Hence, the lamp holder is increased in dielectric strength between the pair of connector terminals. Thus, the discharge lamp unit of the invention has a good insulating effect in the terminal holding region (the region where the pair of lead supports are held).

A second preferred embodiment of a discharge lamp unit constructed in accordance with the invention will be described with reference to FIGS. 6 through 12.

Figure 6:
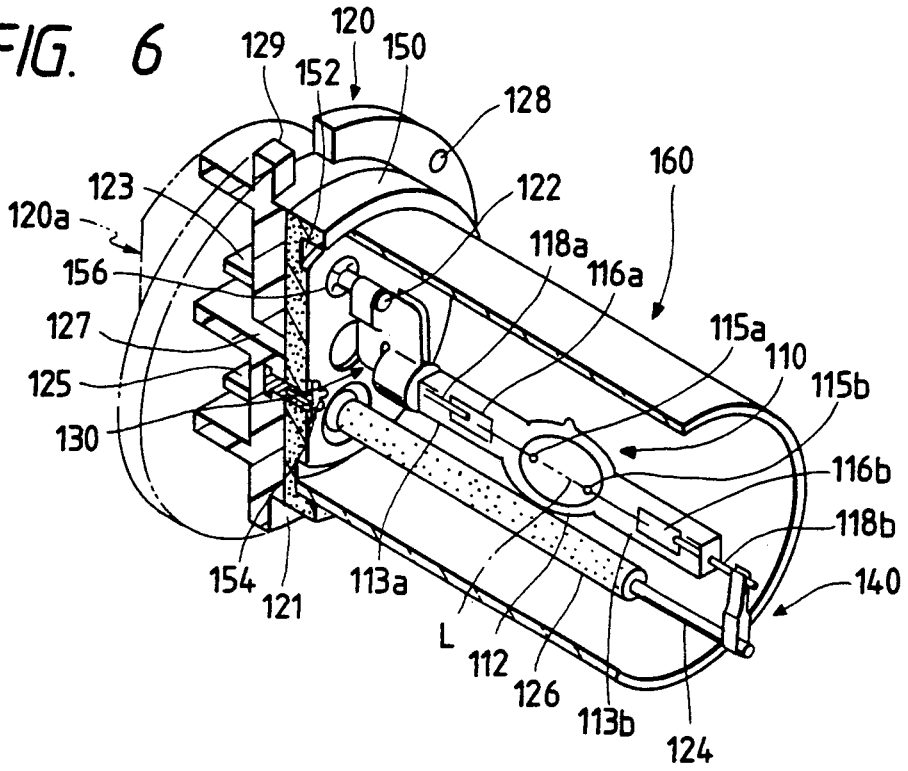
FIG. 6 is a perspective view, with parts cut away, showing a discharge lamp unit of a second preferred embodiment of the invention.
Figure 7:
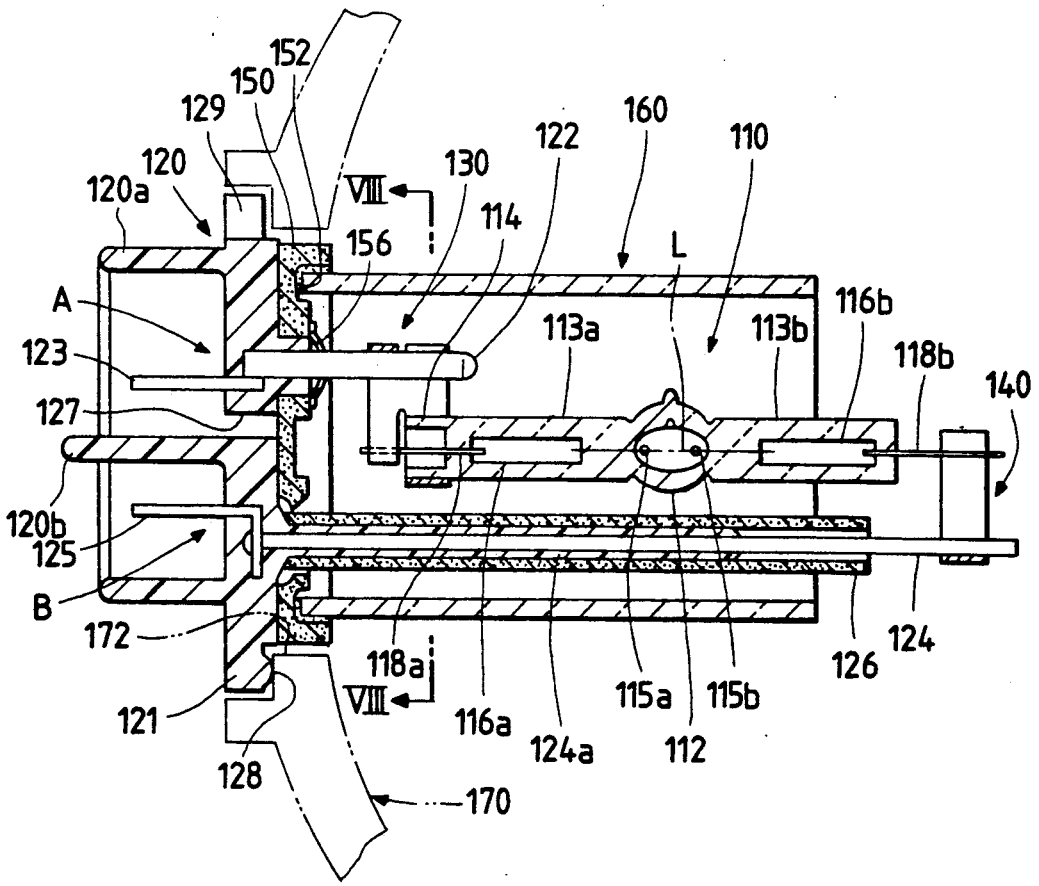
FIG. 7 is a longitudinal sectional view of the discharge lamp unit of FIG. 6.
Figure 8:
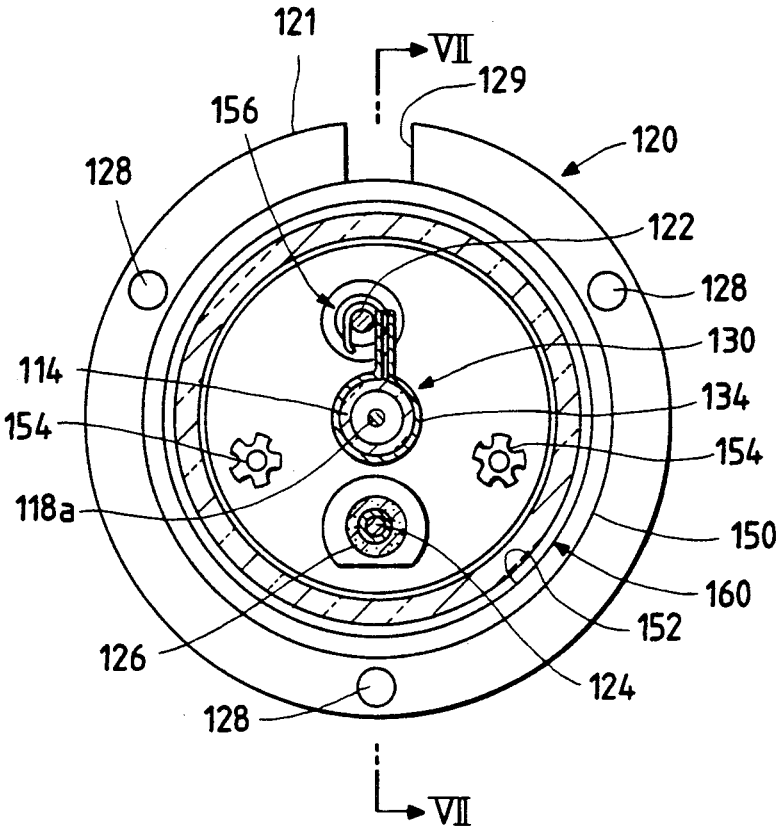
FIG. 8 is a cross sectional view taken along line VIII—VIII in FIG. 7.
Figure 9:
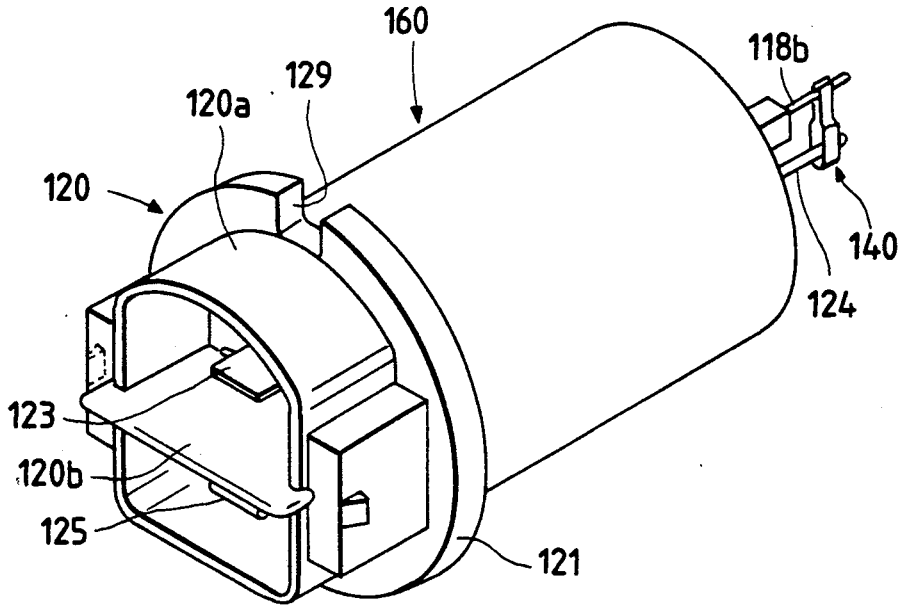
FIG. 9 is a perspective view of the discharge lamp unit of FIG. 6 as viewed from the rear.
Figure 10:
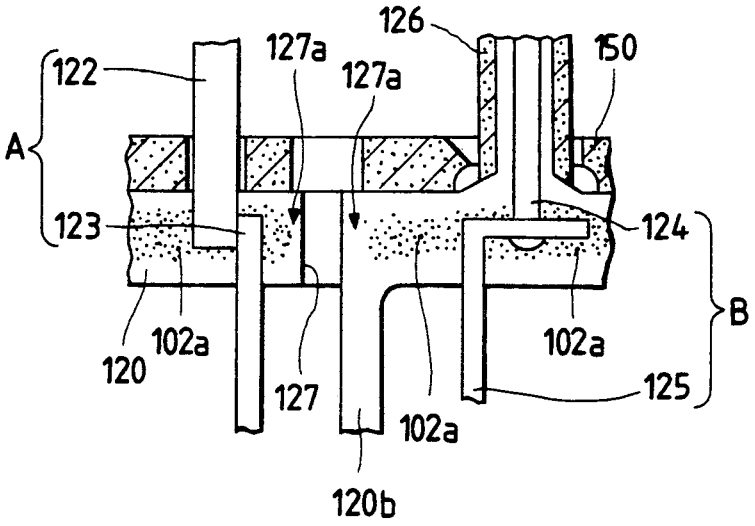
FIG. 10 is a longitudinal sectional view of a portion of the discharge lamp unit of FIG. 6 showing an axial through-hole and related components.
Figure 11:
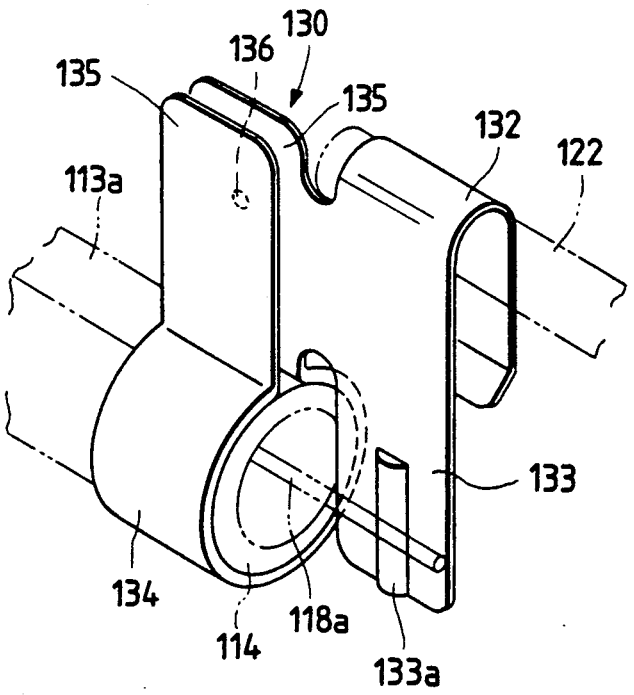
FIG. 11 is a perspective view of a metal support adapted to support the rear end portion of a discharge lamp.
Figure 12:
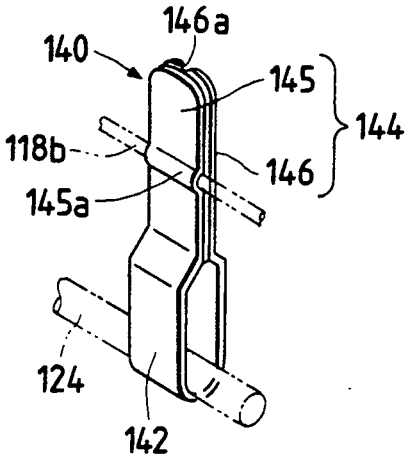
FIG. 12 is a perspective view of a metal support adapted to support the front end portion of the discharge lamp.

FIG. 6 is a perspective view, with parts cut away, showing the discharge lamp unit according to the invention. FIG. 7 is a longitudinal sectional view of the discharge lamp unit. FIG. 8 is a cross sectional view taken along line VIII—VIII in FIG. 7. FIG. 9 is a perspective view of the discharge lamp unit as viewed from the rear. FIG. 10 is a longitudinal sectional view showing an axial through-hole formed with a metal mold, and components around the axial through-hole. FIG. 11 is an enlarged perspective view of a metal support adapted to support the rear end portion of a discharge lamp. FIG. 12 is a perspective view of a metal support adapted to support the front end portion of the discharge lamp.

The discharge lamp unit of this embodiment is formed in the same manner as in the first-described embodiment. That is, the discharge lamp unit includes a light emitting section, namely, a discharge lamp 110, lead supports 122 and 124 protruding from a lamp holder, namely, an insulating base 120, the lead supports serving as current conductors and supporting the discharge lamp 110, metal supports 130 and 140 secured to the lead supports 122 and 124, respectively, to directly support the discharge lamp 110, and an ultraviolet ray shielding globe 160 enclosing the discharge lamp 110 and the discharge lamp supporting members 122, 124, 130 and 140.

The discharge lamp 110 is constructed as follows: A cylindrical-pipe-shaped quartz glass tube is pinched near both ends in such a manner as to form a closed glass ball 112 with pinch-sealed portions **113*a* and 113*b* at both ends, thereby defining an electric discharge space. The pinch-sealed portions 113*a* and 113*b* are each rectangular in longitudinal section, and the closed glass ball 112 is elliptic in longitudinal section. A starting rare gas, mercury and a metal halogenide are sealed in the glass ball 112. The pinch-sealed portion 113*a* is integral with an elongation 114 in the form of a cylindrical pipe which is not pinch-sealed. The elongation 114 is held with a metal support 130 (described later). Discharge electrodes 115*a* and 115*b* made of tungsten are disposed in the electric discharge space in such a manner that they are confronted with each other. The discharge electrodes 115*a* and 115*b* are connected to molybdenum foils 116*a* and 116*b* which are sealed in the pinch-sealed portions 113*a* and 113*b*, respectively. The other ends of the molybdenum foils 116*a* and 116*b* are connected to lead wires 118*a* and 118*b*, respectively, which protrude from the ends of the pinch-sealed portions 113*a*** and 113*b*, respectively. A short lead support 122 and a long lead support 124 are embedded in the insulating base 120 in such a manner that they extend forwardly of the base 120. The lead supports 122 and 124 support the discharge lamp 110 at both ends through the metal supports 130 and 140.

The lead supports 122 and 124 are laid in parallel with each other, and the discharge axis L (passing through the electrodes 115*a* and 115*b*) of the discharge lamp 110 is held in parallel with the lead supports 122 and 124. The insulating base 120 is made of a synthetic resin such as PPS. A flat-plate-shaped connector terminal 23 is connected to the lead support 122 by spot welding in such a manner that it extends from the rear surface of the insulating base 20, while an L-shaped connector terminal 125 is connected to the lead support 124 by plasma welding in such a manner that it is extended from the rear surface of the base 120. The connector terminals 123 and 125 protruding from the rear surface of the base 120 are surrounded by a box-shaped partition wall 120*a*, and are isolated from each other by a lateral partition wall 120*b* extending therebetween, so that the occurrence of electric discharge between the connector terminals 122 and 125 is prevented. The partition wall 120*a* is made arcuate on one side so that the discharge lamp unit is correctly connected to the power supply female connector (not shown) at all times.

In advance, the connector terminal 123 and the lead support 122 are welded together to form a conductor assembly A, and the connector terminal 125 and the lead support 124 are welded together to form a conductor assembly B.

The connection of the terminal 123 and the lead support 122, and the connection of the terminal 125 and the lead support 124, are fixedly held by the insulating 120 during insertion molding. The insulating base 120 has an axially extending through-hole 127 between the lead supports 122 and 124 formed so as to separate the terminals 123 and 125 from each other.

One might expect the presence of an air layer C (which is lower in dielectric strength than the resin forming the base) in the through-hole 127 between the conductor assembly A of the terminal 123 and the lead support 122 and the conductor assembly B of the terminal 125 and the lead support 124 would lower the dielectric strength of the insulating base 120. However, since, in the molding of the insulating base 120, the wall of the through-hole is pushed tightly against the metal mold the material around the through-hole 127 is increased in density, and, as shown in FIG. 11, although blowholes 102*a* are formed scattered in the base 120, no blowholes are formed in the region 127*a* around the through-hole 127. That is, the amount of increase in dielectric strength due to the fact that the material around the through-hole is higher in density exceeds the amount of decrease in dielectric strength due to the presence of the through-hole 127 (or the air layer). That is, the insulating base having the through-hole 127 is higher in dielectric strength than the insulating base having no through-hole, and accordingly substantially no electric discharge occurs between the conductor assemblies A and B. In FIG. 10, reference numeral 126 designates a discharge-preventing ceramic cylinder on the base portion 124*a* of the lead support 124.

The metal support 130 supporting the rear end portion of the discharge lamp 110 is shown in FIG. 11 in detail. The metal support 130 is formed by bending a thin metal plate having a predetermined configuration in such a manner that it has a substantially U-shaped lead support clamping portion 132 and a substantially arcuate lamp holding portion 134. The lead support clamping portion 132 is spot welded to the end portion of the lead support 122.

In FIG. 11, reference numeral 135 designates a pair of plate-shaped elongations extending from both ends of the lamp holding portion 134. A protrusion 136 is formed on one of the surfaces of the plate-shaped elongations 135. The plate-shaped elongations 135 are spot welded together at the protrusion 136 to cause the lamp holding portion 134 to hold the discharge lamp 110. As described above, the lead support clamping portion 132 is U-shaped; that is, it has two substantially parallel portions, one of which extends in such a manner as to confront with the lamp holding portion, namely, a plate-shaped downward elongation 133. The plate-shaped downward elongation 133 has a vertically extending convex stripe 133*a*, to which the rear lead wire 118*a* protruding from the elongation 114 of the discharge lamp 110 is spot welded.

As described above, the elongation 114 of the discharge lamp 110 is held with the lamp holding portion 134 of the metal support 130. Therefore, not only can the discharge lamp be easily slid with respect to the lamp holding portion 134 in its axial direction (to the right and to the left in FIG. 7), but also it can be readily turned. The discharge lamp unit is inserted into a bulb mounting hole 171 formed in a reflector (170 in FIG. 7) when in use. To insert the discharge lamp unit into the discharge lamp unit, the discharge lamp unit is positioned with respect to the reflector 170 with an insulating base periphery 121, which defines a focusing ring, as a reference. Since the discharge lamp 110 is slidable with respect to the lamp holding portion 134 of the metal support 130, the position of the discharge region (or the closed glass ball) of the discharge lamp can be readily adjusted, and particularly its angular position can be adjusted with ease.

The other metal support 140 adapted to support the front end portion of the discharge lamp 110 is shown in FIG. 12 in detail. The metal support 140 is formed by bending a belt-shaped metal plate having a predetermined width in such a manner that it has a lead support clamping portion 142 and a lead wire clamping portion 144. The lead support clamping portion 142 is spot welded to the end portion of the lead support 124. The lead wire clamping portion 144 is composed of a pair of plates 145 and 146 confronted with each other. A horizontal concave stripe 145*a* and a vertical convex stripe 146*a* are formed on the confronting surfaces of the plates 145 and 146, respectively. The lead wire 118*b*, held in the horizontal concave stripe 145*a*, is spot welded to the lead wire clamping portion 144.

A ceramic disk 150 is integrally provided on the front surface of the insulating base 120. The ceramic disk 150 has an annular groove 152 in the front surface, with which an ultraviolet rays shielding globe 160 (described later) is fixedly engaged. The ceramic disk 150 is held abutted against the base 120 as follows: The front ends of two rivets 154, which are embedded in the base 120 in such a manner that they protrude from the front surface of the base 120 by insert-molding, are peened, and a push-on fixer 156 mounted on the lead support 122 is used to fixedly mount the ceramic disk 150 on the insulating base 120.

The ultraviolet ray shielding globe 160, which is in the form of a cylinder made of glass, is secured to the annular groove 152 of the disk 150 with an inorganic adhesive in such a manner as to surround the lead supports 122 and 124 and the discharge lamp 110. In order to ensure the adhesion of the globe 160 and the disk 150, it is desirable that the globe 160 and the disk 150 be substantially equal in thermal expansion coefficient. For this purpose, the globe 160 may be made of borosilicate glass (thermal expansion coefficient: $32.5\times10^{-7}$/°C.), and the disk 150 is made of mullite (thermal expansion coefficient: $36\times10^{-7}$/°C.). The outer wall of the globe 160 is coated with an ultraviolet ray shielding film of ZnO or the like which is effective in cutting off ultraviolet rays 380 nm and lower in wavelength and which present health hazards. Therefore, when the output light of the discharge lamp 110 passes through the ultraviolet ray shielding globe, ultraviolet rays lower than 380 nm in wavelength are cut off; that is, only visible light from which potentially damaging ultraviolet rays have been removed is allowed to emerge from the globe 160.

In order to reduce to zero the transmittance of ultraviolet rays shorter than 370 nm in wavelength, the ultraviolet ray shielding film should have a thickness of at least 1.6 μm. The wavelength range of ultraviolet rays which can be cut off depends on the ambient temperature of the globe (the wavelength range being shifted towards the long wavelength range as the temperature increases). Hence, the film thickness is set to a value with which ultraviolet rays 370 to 380 nm and less in wavelength can be cut off.

The ultraviolet ray shielding film can be formed in the same manner as in the first-described embodiment.

In FIGS. 6 through 8, reference numeral 128 designates protrusions formed on the front surface of the peripheral portion of the insulating base 120 to position the bulb (i.e., the discharge lamp unit). More specifically, the protrusions 144 are abutted against the wall in which the bulb mounting hole 172 is formed, thereby to fix the position of the bulb in the direction of the optical axis.

Further in FIGS. 6 through 8, reference numeral 129 designates a circumferential positioning slot formed in the peripheral portion 121 (the focusing ring) of the insulating base 120. When the bulb (i.e., the discharge lamp unit) is engaged with the bulb mounting hole 172, the slot 146 is engaged with a protrusion (not shown) formed on the side of the bulb mounting hole to position the bulb in the circumferential direction.

Figure 13:
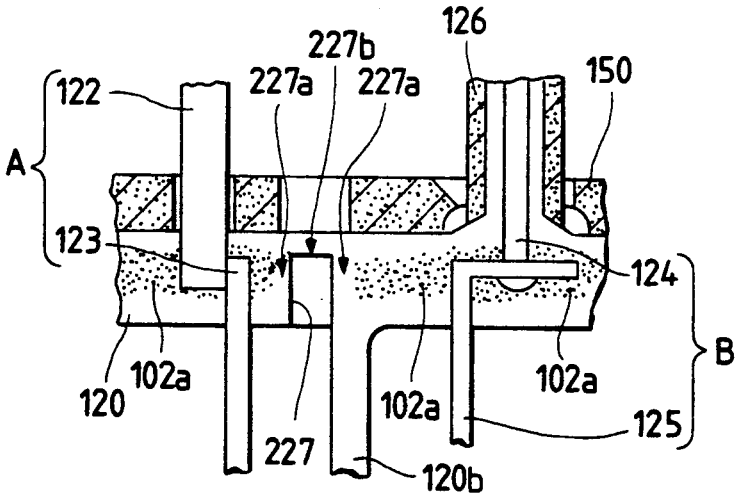
FIGS. 13, 14 and 15 are longitudinal sectional view of a portion of the discharge lamp unit showing modified arrangements of an axial hole or through-hole and related components.

Furthermore, although the above-described embodiment shows a through-hole 42, 127, merely a hole 227 may be applied for the same purpose as shown in FIG. 13 instead of a through-hole. In this arrangement employing the hole 227, no blowholes are formed also in the region **227*b* above the hole 227 in addition to the no blowhole regions 227*a*. Owing to the additional no blowhole region 227*b***, dielectric strength of the lamp holder is much higher between the connector terminals.

Figure 14:
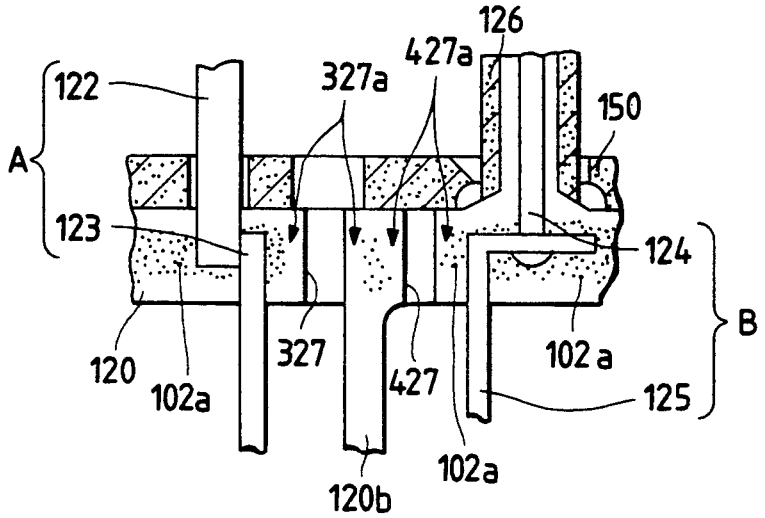
Figure 15:
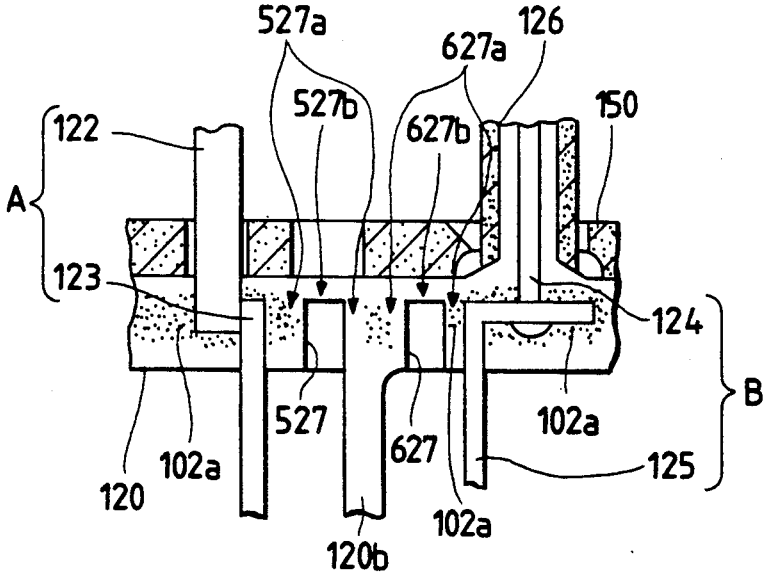

Still further, a pair of through-holes 327, 427 as shown in FIG. 14 and a pair of holes 527, 627 as shown in FIG. 15 may also be arranged. In the arrangement of FIG. 14, no blowhole regions **427*a*, 427*a* in addition to no blowhole regions 327*a*, 327*a* are obtained and, on the other hand, in the arrangement of FIG. 15, no blowhole regions 627*a* and 627*b* in addition to no blowhole regions 527*a* and 527*b* are obtained. Thus, according to the arrangements shown in FIGS. 14 and 15**, dielectric strength of the lamp holder is extremely higher between the connector terminals.

In the above-described embodiment, the lead supports are welded to respective ones of the connector terminals; however, the invention is not limited thereto or thereby. For instance, a metal plate may be bent and shaped to form each of the assemblies of the lead supports and the connector terminals.

As is apparent from the above description, in the discharge lamp unit of the invention, an axial through-hole is formed in the region of the lamp holder in such a manner that it is located between the connector terminals, whereby the adjacent region is higher in material density and contains no blowholes. Hence, the dielectric strength of the lamp holder is higher between the connector terminals; that is, the connector terminals are sufficiently electrically insulated from each other.

Furthermore, the region of the lamp holder which defines the axial through-hole and which is higher in material density with no blowholes is arranged in such a manner as to isolate the connector terminals, as a result of which the connector terminals are positively insulated from each other.

What is claimed is:

1. A discharge lamp unit in which a pair of terminal and lead support assemblies, each comprising a metal connector terminal and a metal lead support, are fixedly held by a lamp holder molded from resin in such a manner that said connector terminals extend from a rear surface of said lamp holder and said lead supports extend from a front surface of said lamp holder to support a discharge lamp, the improvement wherein said lamp holder has at least one axial hole formed therein during molding of said lamp holder in such a manner that said axial hole is located between said connector terminals, wherein portions of said holder adjacent said hole are higher in density than other portions of said holder and are free of blowholes.

2. The discharge lamp unit as claimed in claim 1, wherein said axial hole extends in such a manner as to isolate said connector terminals from each other.

3. The discharge lamp unit as claimed in claim 1, wherein said lamp holder comprises a partition wall surrounding said connector terminals.

4. The discharge lamp unit as claimed in claim 1, wherein said axial hole is a through-hole.

5. The discharge lamp unit as claimed in claim 1, wherein said axial hole is a hole having an upper wall.

6. The discharge lamp unit as claimed in claim 1, wherein the number of said axial holes is one.

7. The discharge lamp unit as claimed in claim 1, wherein the number of said axial holes is two.

8. The discharge lamp unit as claimed in claim 1, wherein said lamp holder is made of a synthetic resin.

9. The discharge lamp unit as claimed in claim 8, wherein said synthetic resin is a PPS synthetic resin.

10. The discharge lamp unit as claimed in claim 1, wherein junction portions of said metal connector terminals and metal lead supports are completely embedded in said lamp holder.

11. The discharge lamp unit as claimed in claim 10, wherein said junction portions of said metal connector terminals and metal lead supports are spot welded to one another.

12. The discharge lamp unit as claimed in claim 1, further comprising an ultraviolet shielding globe disposed around said discharge lamp.

13. The discharge lamp unit as claimed in claim 12, wherein said lamp holder has an L-shaped frame portion on said front surface, said frame portion having an annular groove formed therein receiving an outer flange of said globe.

14. The discharge lamp unit as claimed in claim 13, further comprising an O-ring fitted in said groove for elastically holding said outer flange of said globe in said groove.

15. The discharge lamp unit as claimed in claim 1, further comprising a ceramic disk integrally provided on said front surface.

16. The discharge lamp unit as claimed in claim 15, wherein said ceramic disk is held to said holder by a plurality of rivets embedded in said holder.

17. The discharge lamp unit as claimed in claim 15, further comprising an ultraviolet shielding globe disposed around said discharge lamp.

18. The discharge lamp unit as claimed in claim 17, wherein an annular groove formed in a front surface of said ceramic disk receiving an outer flange of said globe.

19. The discharge lamp unit as claimed in claim 18, wherein said outer flange of said globe is secured in said groove with an inorganic adhesive.

20. A process for assembling a discharge lamp unit, comprising steps of:

providing a pair of terminal and lead support assemblies, each comprising a metal connector terminal and a metal lead support;

molding a lamp holder from resin with said terminal and lead support assemblies embedded therein in such a manner that said lamp holder has at least one axial hole formed therein located between said connector terminals, so that portions of said holder adjacent said hole are higher in density than other portions of said holder and are free of blowholes; and fixing said pair of terminal and lead support assemblies by said lamp holder in such a manner that said connector terminals extend from the rear surface of said lamp holder and said lead supports extend from a front surface of said lamp holder to support a discharge lamp.

* * * * *